United States Patent [19]

Plöger

[11] 4,453,475

[45] Jun. 12, 1984

[54] COMBUSTION CHAMBER CONSTRUCTION

[75] Inventor: Heinz Plöger, Oberhausen, Fed. Rep. of Germany

[73] Assignee: Deutsche Babcock Bau GmbH, Oberhausen, Fed. Rep. of Germany

[21] Appl. No.: 406,706

[22] Filed: Aug. 9, 1982

[30] Foreign Application Priority Data

Aug. 7, 1981 [DE] Fed. Rep. of Germany ..... 3131310

[51] Int. Cl.[3] ..... F23M 5/00

[52] U.S. Cl. ..... 110/336; 110/339; 432/238; 432/247

[58] Field of Search ..... 110/336–340; 52/386, 387, 487, 508, 550, 553; 432/238, 247

[56] References Cited

U.S. PATENT DOCUMENTS 1,830,384 11/1931 Crysler ..... 110/336

FOREIGN PATENT DOCUMENTS 2652507 9/1977 Fed. Rep. of Germany .
2807442 8/1979 Fed. Rep. of Germany .
2272357 1/1976 France .
1453300 10/1976 United Kingdom .

*Primary Examiner*—Henry C. Yuen
*Attorney, Agent, or Firm*—Max Fogiel

[57] ABSTRACT

The inner wall of a combustion chamber is composed of a plurality of ceramic plates which are suspended from the outer wall of the chamber by being hooked over mounting portions of the outer wall; this eliminates the need for screws, bolts, welds or the like and facilitates mounting and dismounting of the plates. The plates define with the outer wall a clearance into which cold air is admitted; the upper and lower edges of adjacent plates define with one another respective air gaps communicating with this clearance so that air streams enter the combustion space through these gaps. These air streams prevent the deposition of ash and other contaminants on the inner surfaces of the plates.

7 Claims, 3 Drawing Figures

COMBUSTION CHAMBER CONSTRUCTION

BACKGROUND OF THE INVENTION

The present invention relates to a combustion chamber.

More especially, the invention relates to a combustion chamber which is particularly well suited for—although not restricted to—use in refuse incinerators.

Special problems exist in the operation of refuse incinerators, because the refuse mix tends to produce combustion products which form slag deposits on the inner wall of the combustion chamber. When this occurs, quite substantial difficulties result in terms of further operation of the incinerator. To overcome this problem it is known to make the inner wall of the combustion chamber—which is spaced with clearance from the gas-tight outer wall—of plates having or defining openings through which air can be passed from the clearance into the combustion chamber. This air prevents the settling of deposition-forming matter on the plates and the problem is thus overcome. However, the prior art is still possessed of difficulties which have heretofore not been solved.

An incinerator is known from German Allowed Application DE-AS No. 2,317,064 in which the plates are of metal and define air-outlet gaps with one another. A problem with this construction is the danger that—should the air supply to the outlet gaps suddenly fail—the metallic plates will corrode under the influence of the temperature prevailing in the combustion chamber, unless specially heat-resistant metal is used which, however, is then again very expensive. Also, metallic plates are relatively heavy and require a correspondingly massive supporting structure to sustain that weight.

Another proposal, made in VGB Kraftwerkstechnik 57 (1977), pp. 341–344, suggests the use of ceramic plates provided with air-outlet holes arranged in form of a grid or raster. These plates are then screwed or bolted to the outer combustion-chamber wall. They are, however, also relatively heavy and quite expensive in terms of manufacture and installation.

SUMMARY OF THE INVENTION

Accordingly, it is an object of the present invention to overcome the problems of the prior art.

A more particular object of the invention is to provide an improved combustion chamber which avoids the prior-art drawbacks.

A still more particular object is to provide such a combustion chamber in which the inner wall is composed of plates having a relatively low weight.

Another object is to provide a combustion chamber of the type in question, i.e. one which is well suited for use with incinerators but is not limited to such use, in which the aforementioned plates are highly heat-resistant even in the event of an interruption in the flow of incoming air.

A concomitant object is to provide such a combustion chamber wherein the plates can be installed, removed and replaced in a simple, time- and cost-saving manner.

In keeping with these objects, and still others which will become apparent hereafter, one aspect of the invention resides in a combustion chamber, particularly for refuse incinerators. Briefly stated, such a combustion chamber may comprise first means forming an outer wall bounding a combustion space, and second means forming an inner wall also bounding this space and comprising a plurality of plates each having an upper and a lower edge region. There are further provided cooperating mounting portions on the first means and on the upper edge regions of the plates, so that the plates can be suspended vertically—or at least substantially vertically—on the first means in order to define with the same a clearance through which the deposition-preventing air is blown.

The plates may be of any suitably heat-resistant ceramic material known from the prior art; silicone carbide has been found to be especially advantageous. Due to the material used, the plates are relatively light in weight and, of course, their material is not subject to the kind of heat damage experienced by metal plates in the event the supply of air is interrupted.

The cooperating mounting portions include parts or elements on the outer wall which are vertically spaced from one another by a distance smaller than the distance between the upper and lower edges of the respective plates, and parts or elements on the upper plate edge regions which are shaped so that they can be hooked or hung over the parts on the outer wall. Thus, the plates are suspended on the outer wall merely by hooking their mounting portions over those on the outer wall; no installation work such as screwing, bolting or other securing is required. Such hooking (and unhooking if the plates are to be detached for inspection and/or replacement) is extremely quick and can be carried out for any individual plate without in any way affecting adjacent plates which remain untouched by such an operation.

Moreover, the plates are relatively inexpensive to produce, since the air-outlet gaps are formed between their edge portions; which is to say, the plates are slid and need not be formed with air holes as in some of the prior art, a manufacturing sequence which adds considerably to the cost of the prior-art plates.

The plates according to the present invention have good thermal conductivity so that the inner wall formed by them remains relatively cool at all times. This means that it is difficult or even impossible for hot, more or less viscous ash particles to adhere to this inner wall.

Finally, the inflowing air coming through the air inlet gaps between the suspended plates—and whose speed and quantity per unit/time are variable and can be accommodated to the momentary operating conditions, as is known per se—prevents the build-up of heat at and adjacent the combustion-chamber walls, and this heat is instead restored to the combustion process.

The invention will hereafter be described with reference to an exemplary embodiment, as illustrated in the appended drawing. However, it is to be understood that this is for purposes of explanation only and that the protection sought for the invention is defined exclusively in the claims.

DESCRIPTION OF PREFERRED EMBODIMENTS

Figure 1:
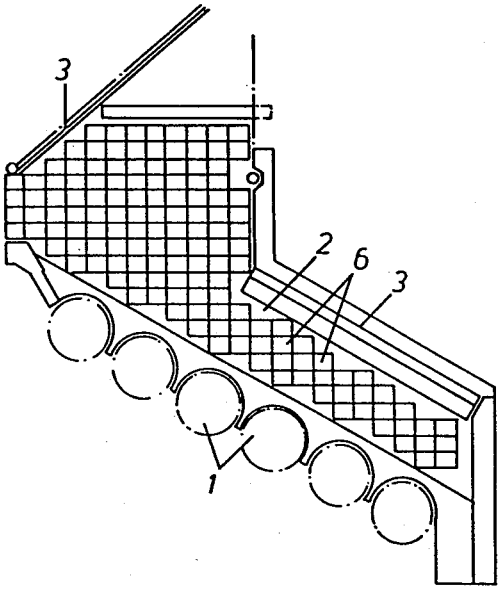
FIG. 1 is a front view, diagrammatically illustrating a combustion chamber embodying the invention.

The combustion chamber shown in FIG. 1 will be assumed to be that of a refuse incinerator; however, as already mentioned before, this is for purposes of explanation only and the invention is in no way limited to refuse incinerators.

The combustion chamber will be seen to have a combustion grate 1 which is here constructed of a series of cylindrical rollers, air-cooled side walls 2 and a ceiling 3. The other components of the system, e.g. the heat-recovery boiler connected with the chamber, are not illustrated since they are known per se.

The side walls 2 of the chamber are composed of an outer wall and an inner wall. The outer wall, in turn, is composed of a support or frame structure constituted by vertical beams 4 which are connected by horizontal beams 5, and by a gas-tight sheet-metal enclosure 6 (shown only in part in FIG. 2) which is screwed, welded, bolted or otherwise secured to the frame structure (here to that side thereof which faces inwardly towards the combustion space). The inner wall is inwardly spaced from the outer wall and is constituted of a plurality of the aformentioned plates (here designated with reference numeral 7) of ceramic material. These define with the outer wall a clearance 8 with which air supply pipes 9 communicate, via which the clearance 8 receives cold air from outside. Adjacent plates 7 in turn define between their adjacent edges respective air inlet gaps 10 through which the air admitted into the clearance 8 escapes and is allowed to enter into the combustion chamber.

In accordance with the invention, mounting or suspending portions are provided on the outer and inner walls and cooperate with one another for suspending the plates 7 parallel or substantially parallel to the sheet-metal enclosure 6. The portions 11 are provided on the horizontal beams 5 to which they may be screwed, bolted, welded or otherwise secured; they are composed of a highly heat-resistant alloyed castable material, for example.

The vertical spacing between these portions 11 is so chosen that it is smaller than the height (i.e. vertical dimension) of the plates 7, in order to assure the existence of the gaps 10. Thus, decreasing the vertical distance between portions 11 assures the existence of gaps 10. Each of the portions 11 has two functions: it suspends one of the plates 7 at the upper edge region thereof and it engages and supports (from behind) the lower edge region of the respectively superjacent plate 7 (see FIG. 3). For this purpose it has been found to be especially advantageous to make the portions 11 in form of U-shaped profiles (they may be cut-offs from a U-shaped profile beam) and to so mount them on the beams 5 that the two arms of their U-shaped configuration are located in vertically spaced planes.

As already mentioned, the plates 7 are of ceramic material which may, but need not be, silicone carbide. The mounting portions on the upper edge regions of these plates 7 are designated with reference numeral 12; they are seen (FIG. 3) to be generally hook-shaped and may be separate elements secured to the plates 7. However, it is currently preferred—and maximum manufacturing economy is obtained—for them to be formed of one piece with the respective plate during manufacture of the same. The lower arm 13 of each of the portions 11 is provided with a bead 14 which is so shaped that the portion 12 of a respective plate 7 can be hooked over it, thus suspending the plate from the lower arm 13. In turn, the lower edge region of the thus suspended plate 7 rests against the upper arm 15 of the next lower (subjacent) portion 11, so that—although the plates 7 are freely suspended without any screws or the like—they cannot swing outwardly against the enclosure 6.

Figure 2:
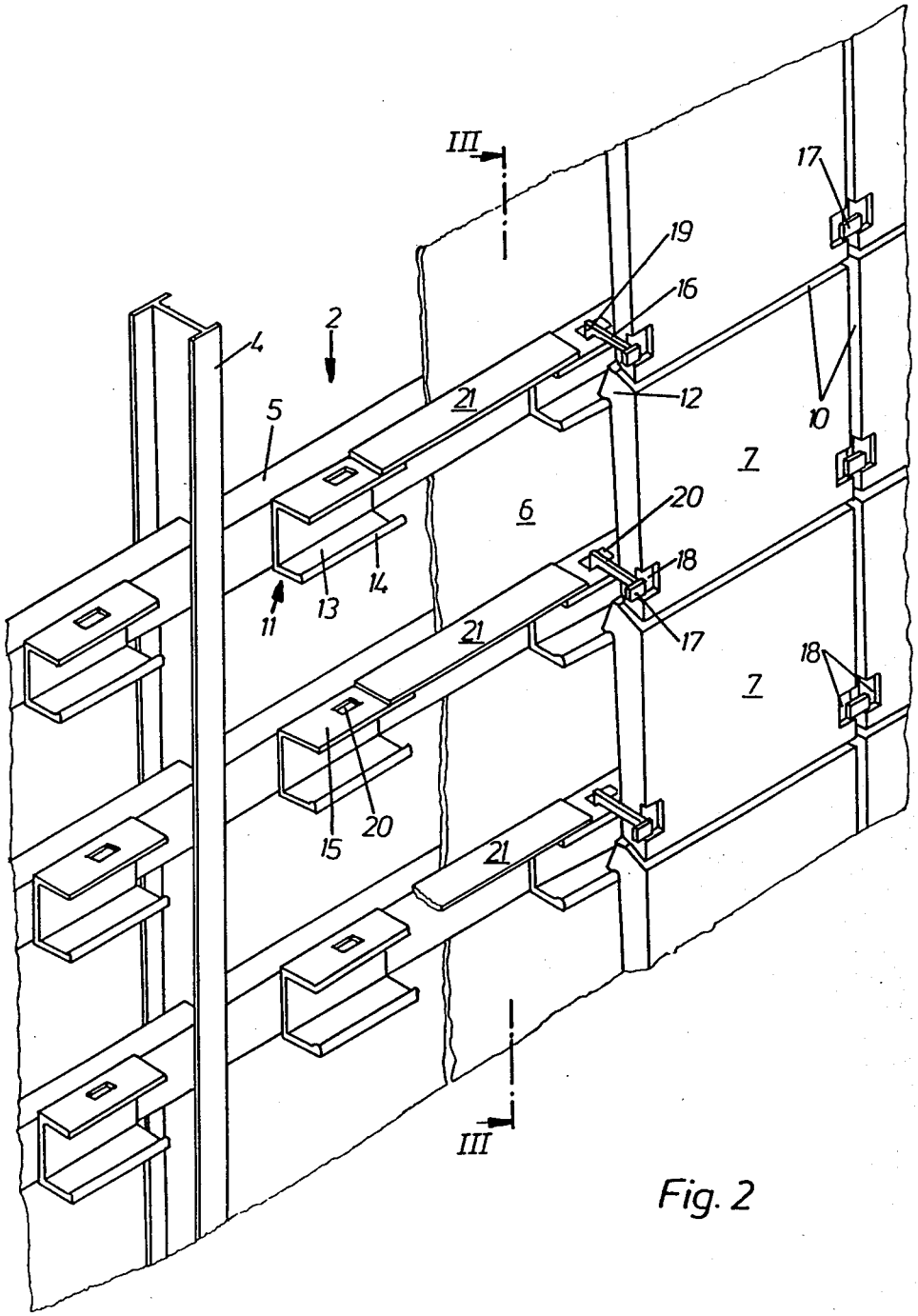
FIG. 2 is a perspective view, showing a side wall of the combustion chamber in FIG. 1.
Figure 3:
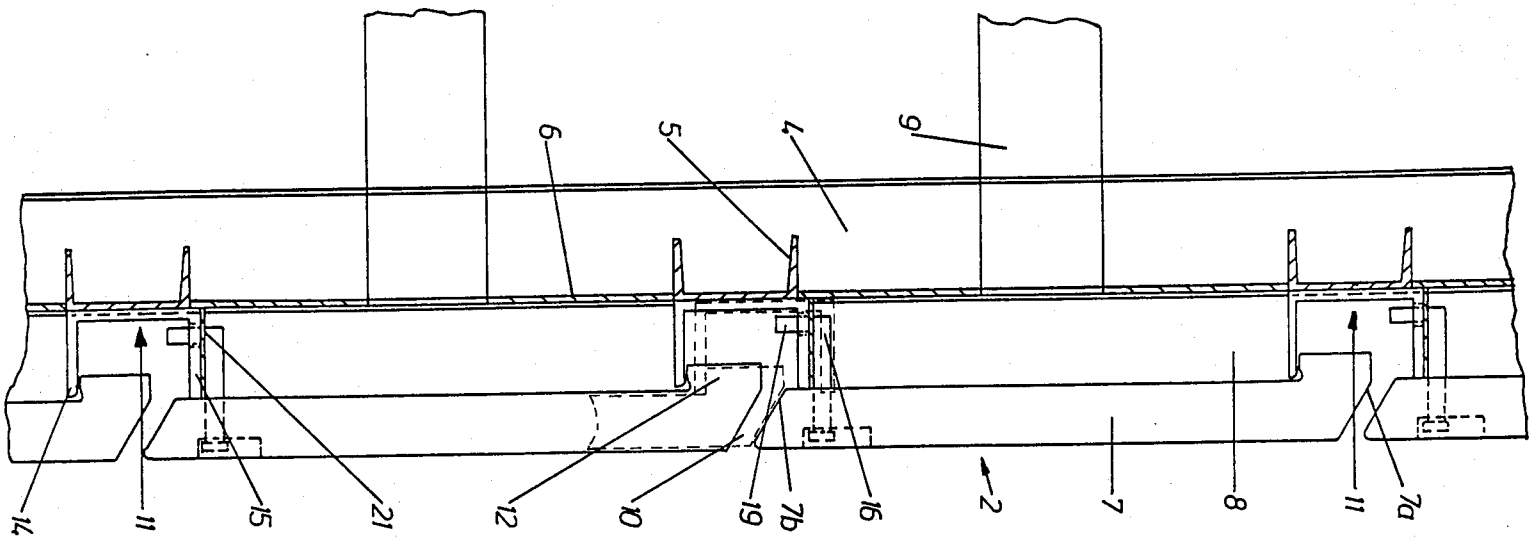
FIG. 3 is a vertical section on line III—III of FIG. 2.

FIGS. 2 and 3 shows that a hook 16 extends from any two of the plates 7 and has a head 17 which overlaps two adjacent plates 7. The plates 7 have lateral recesses 18 which receive the head 17. Hook 16 has a downwardly angled part 19 (FIGS. 2 and 3) which engages in a slot or opening 20 in the upper arm 15 of the respective portion 11. The cooperation of the portions 11 and 12 allows the plates 7 to be individually mounted and dismounted without requiring any changes whatsoever in the mounting, positioning or presence of laterally or vertically adjacent plates 7.

As FIG. 3 shows, the upper end and lower edges 7*a*, 7*b* of the plates 7 are bevelled at identical angles, so that the edge 7*a* of each subjacent plate defines with the edge 7*b* of the respective superjacent plane one of the air gaps 10. The cold air admitted into clearance 8 via the pipes 9 enters the combustion chamber through these gaps 10. It will be noted that the bevels on the edge portions 7*a*, 7*b* are such that the air streams passing through the gaps 10 flow into the combustion chamber in downward direction. These air streams have the dual purpose of preventing the deposition of ash and similar matter on the plates 7 (i.e. on the sides thereof which face towards the combustion space) and of preventing the entry of such matter through the gaps 10 into the clearance 8 (due to the downward component of movement of the air streams).

The clearance 8 is subdivided into horizontal sections by sheet-metal separators 21 which rest on (and may be additionally secured to) the portions 11. Each of these sections communicates with one of the air supply pipes 9 (see FIG. 3). However, it is clear that the clearance 8 could, instead, be divided into vertical sections by the use of vertically oriented separators; in fact, both horizontal and vertical separators may be used in conjunction with one another, if desired.

The invention has hereinbefore been described with reference to its application in the combustion chamber of a refuse incinerator. However, as mentioned earlier, the invention can be used in combustion chambers of other types of installations and is in no way limited to refuse incinerators. Furthermore, the invention is not limited to the specific details shown, since various changes and modifications may be made in and with respect to the illustrated exemplary embodiment without departing from the gist of the invention. Accordingly, it is to be understood that the protection sought for the invention is defined solely by the appended claims.

I claim:

1. A combustion chamber, particularly incinerators, comprising: first means forming an outer wall bounding a combustion space; second means forming an inner wall bounding said space and comprising a plurality of plates each having an upper and a lower edge region; and cooperating mounting portions on said first means and said upper edge regions of said plates for suspending the plates at least substantially vertically on said first means so as to define a clearance with said outer wall for passing air to the interior of the combustion space; said first means comprising an upright supporting structure and a gas-tight sheet-metal enclosure mounted on said supporting structure; said plates being of ceramic material; said plates being vertically oriented and having a predetermined height in vertical direction; said mounting portions including first mounting portions on said supporting structure which are vertically spaced from one another by a distance smaller than said predetermined height; said plates also having respective upper and lower edges on said edge regions thereof; said mounting portions including second mounting portions on said upper edge regions of said plates, said second mounting portions being substantially hook-shaped and hooked onto a respective one of said first mounting portions so that each plate is suspended from one of said first mounting portions, the lower edge regions of each thus suspended plate being supported against one of said first mounting portions which is adjacent to the first mounting portion from which the respective plate is suspended; said first mounting portions being U-shaped profiles each having a pair of generally horizontal arms including an upper arm against which the lower edge region of a superjacent plate is supported, and a lower arm from which the second mounting portion of a subjacent plate is suspended; each of said first mounting portions having an opening; and further comprising a plurality of hook elements each engaged in one of said openings and each also engaging at least one of said plates so as to prevent the plate from swinging.

2. A combustion chamber as defined in claim 1, wherein said ceramic material is silicone carbide.

3. A combustion chamber as defined in claim 1; and further comprising partitions dividing said clearance into a plurality of generally horizontal sections; and air supply conduits communicating with the respective sections.

4. A combustion chamber, particularly incinerators, comprising: first means forming an outer wall bounding a combustion space; second means forming an inner wall bounding said space and comprising a plurality of plates each having an upper and a lower edge region; and cooperating mounting portions on said first means and said upper edge regions of said plates for suspending the plates at least substantially vertically on said first means so as to define a clearance with said outer wall for passing air to the interior of the combustion space; said first means comprising an upright supporting structure and a gas-tight sheet-metal enclosure mounted on said supporting structure; said plates being of ceramic material; said plates being vertically oriented and having a predetermined height in vertical direction; said mounting portions including first mounting portions on said supporting structure which are vertically spaced from one another by a distance smaller than said predetermined height; said plates also having respective upper and lower edges on said edge regions thereof; said mounting portions including second mounting portions on said upper edge regions of said plates, said second mounting portions being substantially hook-shaped and hooked onto a respective one of said first mounting portions so that each plate is suspended from one of said first mounting portions, the lower edge regions of each thus suspended plate being supported againt one of said first mounting portions which is adjacent to the first mounting portion from which the respective plate is suspended; said first mounting portions being U-shaped profiles each having a pair of generally horizontal arms including an upper arm against which the lower edge region of a superjacent plate is supported, and a lower arm from which the second mounting portion of a subjacent plate is suspended; each of said first mounting portions having an opening; and further comprising a plurality of hook elements each engaged in one of said openings and each also engaging at least one of said plates so as to prevent the plate from swinging; said upper and lower edges being bevelled, and wherein the upper edge of each subjacent plate defines with the lower edge of the respective superjacent plate an air gap having an inlet communicating with said clearance and an outlet located lower than said inlet and communicating with said combustion space.

5. A combustion chamber as defined in claim 4; and further comprising partitions dividing said clearance into a plurality of generally vertical sections; and air supply conduits communicating with the respective sections.

6. A combustion chamber as defined in claim 5; and further comprising additional partitions dividing said vertical sections horizontally into a plurality of compartments, said conduits each communicating with one of said compartments.

7. A combustion chamber, particularly incinerators, comprising: first means forming an outer wall bounding a combustion space; second means forming an inner wall bounding said space and comprising a plurality of plates each having an upper and a lower edge region; and cooperating mounting portions on said first means and said upper edge regions of said plates for suspending the plates at least substantially vertically on said first means so as to define a clearance with said outer wall for passing air to the interior of the combustion space; said first means comprising an upright supporting structure and a gas-tight sheet-metal enclosure mounted on said supporting structure; said plates being of ceramic material; said plates being vertically oriented and having a predetermined height in vertical direction; said mounting portions including first mounting portions on said supporting structure which are vertically spaced from one another by a distance smaller than said predetermined height; said plates also having respective upper and lower edges on said edge regions thereof; said mounting portions including second mounting portions on said upper edge regions of said plates, said second mounting portions being substantially hook-shaped and hooked onto a respective one of said first mounting portions so that each plate is suspended from one of said first mounting portions, the lower edge regions of each thus suspended plate being supported against one of said first mounting portions which is adjacent to the first mounting portion from which the respective plate is suspended; said first mounting portions being U-shaped profiles each having a pair of generally horizontal arms including an upper arm against which the lower edge region of a superjacent plate is supported, and a lower arm from which the second mounting portion of a subjacent plate is suspended.

* * * * *